US009111476B2

(12) United States Patent
Kim et al.

(10) Patent No.: US 9,111,476 B2
(45) Date of Patent: Aug. 18, 2015

(54) APPARATUS AND METHOD FOR DRIVING LIQUID CRYSTAL DISPLAY DEVICE

(71) Applicant: LG Display Co., Ltd., Seoul (KR)

(72) Inventors: Min-Ki Kim, Namyul-ri (KR); Jin-Sung Kim, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 356 days.

(21) Appl. No.: 13/678,265

(22) Filed: Nov. 15, 2012

(65) Prior Publication Data

US 2013/0141404 A1 Jun. 6, 2013

(30) Foreign Application Priority Data

Nov. 17, 2011 (KR) ..... 10-2011-0120526

(51) Int. Cl.
*G09G 3/36* (2006.01)
*G09G 5/00* (2006.01)

(52) U.S. Cl.
CPC ..... *G09G 5/003* (2013.01); *G09G 3/3692* (2013.01); *G09G 2300/0408* (2013.01); *G09G 2310/08* (2013.01)

(58) Field of Classification Search
CPC ..... G09G 3/3685; G09G 3/3361
USPC ..... 345/100
See application file for complete search history.

(56) References Cited

U.S. PATENT DOCUMENTS

| | | | | |
|---|---|---|---|---|
| 6,995,758 | B2 * | 2/2006 | Fukuda | 345/205 |
| 2002/0075204 | A1 | 6/2002 | Nakano et al. | |
| 2005/0168429 | A1 * | 8/2005 | Chou | 345/100 |
| 2006/0202936 | A1 * | 9/2006 | Chen et al. | 345/100 |

FOREIGN PATENT DOCUMENTS

| | | | |
|---|---|---|---|
| CN | 1335590 | A | 2/2002 |
| JP | 2009-069198 | * | 4/2009 |
| JP | 2010-190932 | | 9/2010 |

OTHER PUBLICATIONS

Office Action issued in Chinese Patent Application No. 201210466944.9, mailed Jul. 3, 2014, 11 pages.

* cited by examiner

*Primary Examiner* — Roy Rabindranath
(74) *Attorney, Agent, or Firm* — Brinks Gilson & Lione

(57) ABSTRACT

An apparatus and method for driving an image display device are disclosed. The disclosed driving apparatus and method achieve synchronous driving of driving integrated circuits for driving an image display panel, through internal generation of drive control signals, thereby preventing a degradation in picture quality caused by erroneous driving timing while achieving an enhancement in product reliability. The driving apparatus includes a display panel, which includes a plurality of pixel regions, to display an image, a plurality of data integrated circuits, which share at least one of synchronizing signals internally generated therefrom, generate gate and data control signals in accordance with the shared synchronizing signal, and drive data lines of the display panel, using the internally-generated data control signals, and a gate driver for driving gate lines of the display panel in accordance with the gate control signal generated from one of the plural data integrated circuits.

10 Claims, 5 Drawing Sheets

APPARATUS AND METHOD FOR DRIVING LIQUID CRYSTAL DISPLAY DEVICE

This application claims the benefit of the Korean Patent Application No. 10-2011-0120526, filed on Nov. 17, 2011, which is hereby incorporated by reference as if fully set forth herein.

BACKGROUND

1. Field of the Disclosure

The present disclosure relates to an image display device, and more particularly, to an apparatus and method for driving an image display device, which are capable of achieving synchronous driving of driving integrated circuits for driving an image display panel, through internal generation of drive control signals, thereby preventing a degradation in picture quality caused by erroneous driving timing and achieving an enhancement in product reliability.

2. Discussion of the Related Art

Recently, image display devices of various types have been proposed as a means for displaying digital content. Of the proposed image display devices, flat display devices are most generally used. Flat display devices include, for example, a liquid crystal display device, an organic light emitting display device, a field emission display device, a plasma display panel.

In a general image display device, in which a plurality of pixels is arranged on a display panel, an image is displayed through adjustment of light transmittance or light emission amount of each pixel. To this end, the pixels are arranged in a matrix array in the display panel, and driving circuits are provided in the image display device, to drive the display panel.

In such an image display device, for example, data integrated circuits, which are included in the driving circuits of the image display device, to constitute a data driver, may be attached to at least one source printed circuit board, printed circuit film or the like or may be directly mounted on the display panel. Also, gate integrated circuits may be separately attached to one side of the display panel or may be directly formed on the display panel. Meanwhile, in the case of a timing controller to control the above-mentioned driving integrated circuits or a graphic system, the timing controller is separately provided at a separate control printed circuit board, system board or the like, to supply driving control signals required in the gate and data integrated circuits.

Recently, a proposal to integrate a timing controller and a data driving integrated circuit in the form of a single chip has been made, for application of a one-chip-integrated driving integrated circuit. However, for application of plural one-chip-integrated driving integrated circuits, there is a problem in that the plural driving integrated circuits should be synchronously driven, even though they internally generate driving control signals for driving thereof. In other words, synchronous driving of the driving integrated circuits is possible when the same synchronizing signals are externally supplied to the plural driving integrated circuits, which, in turn, generate driving control signals for driving thereof, respectively. When the driving integrated circuits internally generate driving control signals without external synchronizing signals, it is difficult to achieve synchronization of the driving integrated circuits. For this reason, in conventional cases, there may be a degradation in picture quality caused by erroneous driving timing and a degradation in product reliability caused by a degradation in picture quality.

SUMMARY

An apparatus for driving an image display device includes a display panel, which includes a plurality of pixel regions, to display an image, a plurality of data integrated circuits, which share at least one of synchronizing signals internally generated therefrom, generate gate and data control signals in accordance with the shared synchronizing signal, and drive data lines of the display panel, using the internally-generated data control signals, and a gate driver for driving gate lines of the display panel in accordance with the gate control signal generated from one of the plural data integrated circuits.

In another aspect of the present invention, a method for driving an image display device includes sharing, by a plurality of data integrated circuits, at least one of synchronizing signals internally generated from the plural data integrated circuits, internally generating gate and data control signals from the plural data integrated circuits in accordance with the shared synchronizing signal, and driving data lines of a display panel, using the internally-generated data control signals, and driving gate lines of the display panel in accordance with the gate control signal of one of the plural data integrated circuits.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE EXEMPLARY EMBODIMENTS

Reference will now be made in detail to the preferred embodiments of the present invention relating to an apparatus and method for driving an image display device, examples of which are illustrated in the accompanying drawings. The image display device may be a liquid crystal display device, an organic light emitting display device, a field emission display device, a plasma display panel, or the like. For convenience of description, however, the following description will be given only in conjunction with a liquid crystal display device.

Figure 1:
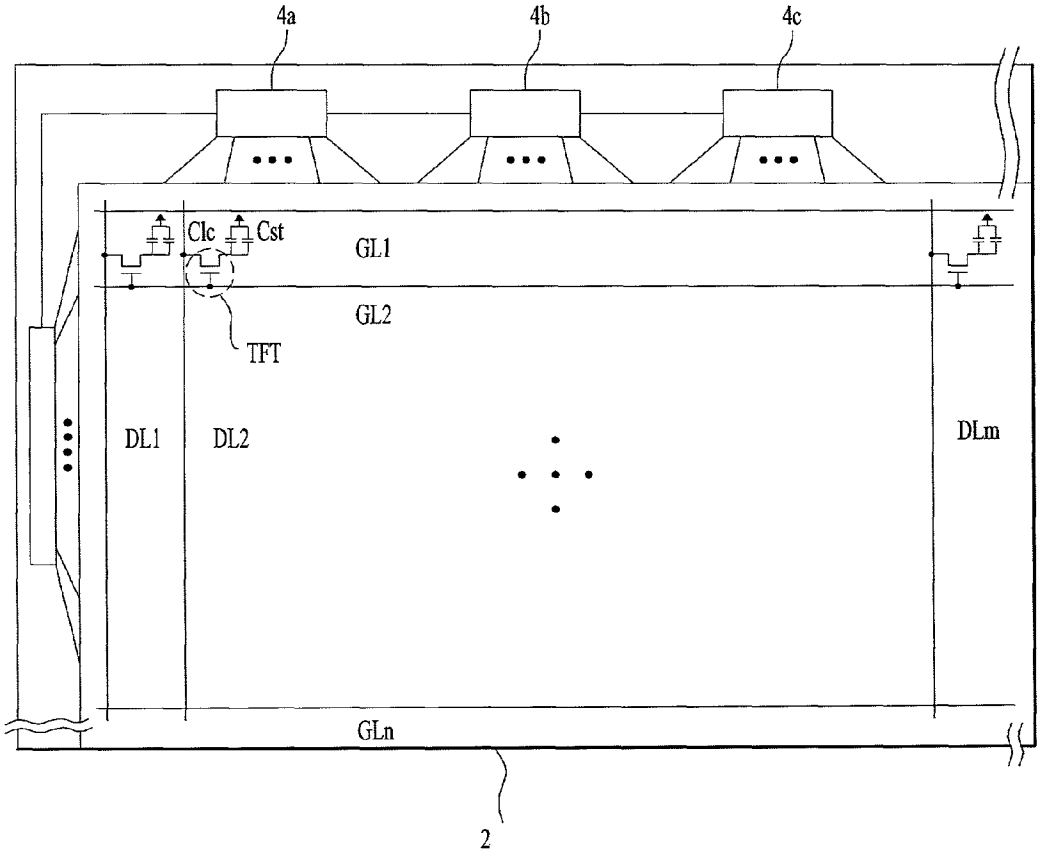
FIG. 1 is a diagram illustrating a configuration of an apparatus for driving a liquid crystal display device in accordance with an exemplary embodiment of the present invention.

FIG. 1 is a diagram illustrating a configuration of an apparatus for driving a liquid crystal display device in accordance with an exemplary embodiment of the present invention.

The driving apparatus shown in FIG. 1 includes a liquid crystal panel 2 including a plurality of pixel regions, to display an image, and a plurality of data integrated circuits 4*a* to 4*c*. The data integrated circuits 4*a* to 4*c* share at least one of synchronizing signals internally generated therefrom, generate gate and data control signals in accordance with the shared synchronizing signal, and drive a plurality of data lines DL1 to DLm of the liquid crystal panel 2, using the internally-generated data control signals. The driving apparatus also includes a gate driver for driving a plurality of gate lines GL1 to GLn of the liquid crystal panel 2 in accordance with the gate control signal generated from one of the plural data integrated circuits 4*a* to 4*c*.

The liquid crystal panel 2 is divided into an image display area, on which pixel regions defined by the gate lines GL1 to GLn and data lines DL1 to DLm are formed in the form of a matrix array, to display an image, and an image non-display area, on which no image is displayed. The liquid crystal panel 2 includes a thin film transistor (TFT) formed on each pixel region on the image display area, and a liquid crystal capacitor Clc connected to the TFT. The liquid crystal capacitor Clc includes a pixel electrode connected to the TFT, and a common electrode facing the pixel electrode such that a liquid crystal layer is interposed between the pixel electrode and the common electrode. The TFT supplies, to the pixel electrode, an image signal from a corresponding one of the data lines DL1 to DLm in response to a scan pulse from a corresponding one of the gate lines GL1 to GLn. The liquid crystal capacitor Clc is charged with a difference voltage between the image signal supplied to the pixel electrode and a common voltage supplied to the common electrode. The alignment of liquid crystal molecules is varied in accordance with the difference voltage and, as such, light transmittance of the pixel region is adjusted. Thus, a desired grayscale is obtained. A storage capacitor Cst is connected to the liquid crystal capacitor Clc in parallel, to allow the voltage charged in the liquid crystal capacitor Clc to be maintained until a next data signal is supplied. The storage capacitor Cst is formed in accordance with overlap of the pixel electrode and the gate line preceding the gate line corresponding to the pixel electrode under the condition that an insulating film is interposed between the pixel electrode and the preceding gate line. Alternatively, the storage capacitor Cst may be formed in accordance with overlap of the pixel electrode with a storage line under the condition that an insulating film is interposed between the pixel electrode and the storage line.

The liquid crystal panel 2 may be divided into a plurality of display regions in accordance with a plurality of data line driving regions where respective data integrated circuits 4*a* to 4*c* are driven. The data integrated circuits 4*a* to 4*c* are mounted on the image non-display area of the liquid crystal panel 2 such that they correspond to respective data line driving regions. Similarly, the gate driver 3 is formed or mounted on the image non-display area in accordance with an arrangement direction of the gate lines, to drive the plural gate lines GL1 to GLn.

Each of the plural data integrated circuits 4*a* to 4*c* is constituted by integrating a conventional timing controller and a conventional data driving circuit in the form of a single chip. Upon externally receiving a plurality of synchronizing signals, the one-chip data integrated circuits 4*a* to 4*c* align image data externally supplied thereto such that the image data is suitable for driving the liquid crystal panel 2, using the received synchronizing signals, to latch the image data by the unit of at least one horizontal line. Using other externally-input synchronizing signals, for example, a dot clock, a data enable signal, and horizontal and vertical synchronizing signals, each of the data integrated circuits 40*a* to 4*c* generates gate and data control signals. On the other hand, when the data integrated circuits 4*a* to 4*c* are driven under the condition that there is no externally-input synchronizing signal, they internally generate synchronizing signals, align image data externally input thereto such that the image data is suitable for driving the liquid crystal panel 2, and latch the aligned image data by the unit of at least one horizontal line. Also, each of the data integrated circuits 4*a* to 4*c* internally generates gate and data control signals, using other synchronizing signals internally generated therein. The data integrated circuits 4*a* to 4*c* share one of the synchronizing signals internally generated therein, to control generation timing of the gate and data control signals in accordance with the shared synchronizing signal.

The gate driver 3 may be formed on the image non-display area of the liquid crystal panel 2, to be integrated with the liquid crystal panel 2. Alternatively, the gate driver 3 may be mounted on the image non-display area of the liquid crystal panel 2, in the form of an integrated circuit. The gate driver 3 sequentially drives the plural gate lines GL1 to GLn. In detail, the gate driver 3 sequentially supplies a scan pulse to the gate lines GL1 to GLn in accordance with gate control signals from at least one of the data integrated circuits, for example, a gate start pulse, a gate shift clock and a gate output enable signal from the data integrated circuit 4*a*. The gate driver 3 supplies a gate low voltage to the gate lines GL1 to GLn during a period, for which no scan pulse is supplied.

Figure 2:
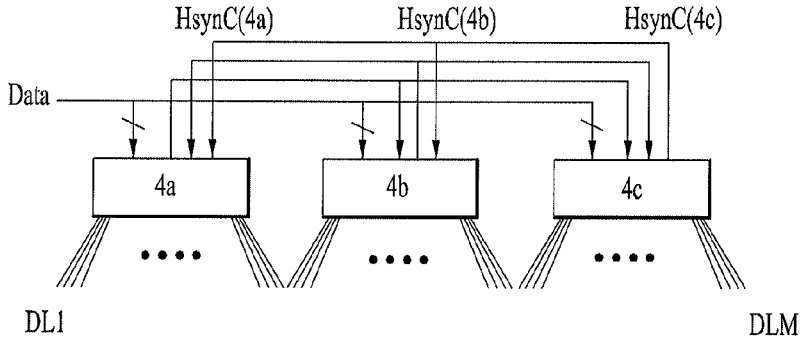
FIG. 2 is a diagram illustrating connection relation among a plurality of driving integrated circuits shown in FIG. 1.

FIG. 2 is a diagram illustrating connection relation among the plural driving integrated circuits shown in FIG. 1.

The plural driving integrated circuits shown in FIG. 2, namely, the plural data integrated circuits 4*a* to 4*c*, are mounted on the image non-display area of the liquid crystal panel 2 such that they correspond to respective data line driving regions. Accordingly, when any one of the data integrated circuits 4*a* to 4*c* is driven without being synchronized with the data integrated circuit neighboring thereto, image mismatch may occur between corresponding neighboring display regions. To this end, the plural data integrated circuits 4*a* to 4*c* share one of the synchronizing signals internally generated therefrom, for example, one horizontal synchronizing signal Hsync. In accordance with the shared horizontal synchronizing signal Hsync, each of the data integrated circuits 4*a* to 4*c* may further generate a vertical synchronizing signal. Also, each of the data integrated circuits 4*a* to 4*c* may generate gate and data control signals, using the generated vertical and horizontal synchronizing signals.

Figure 3:
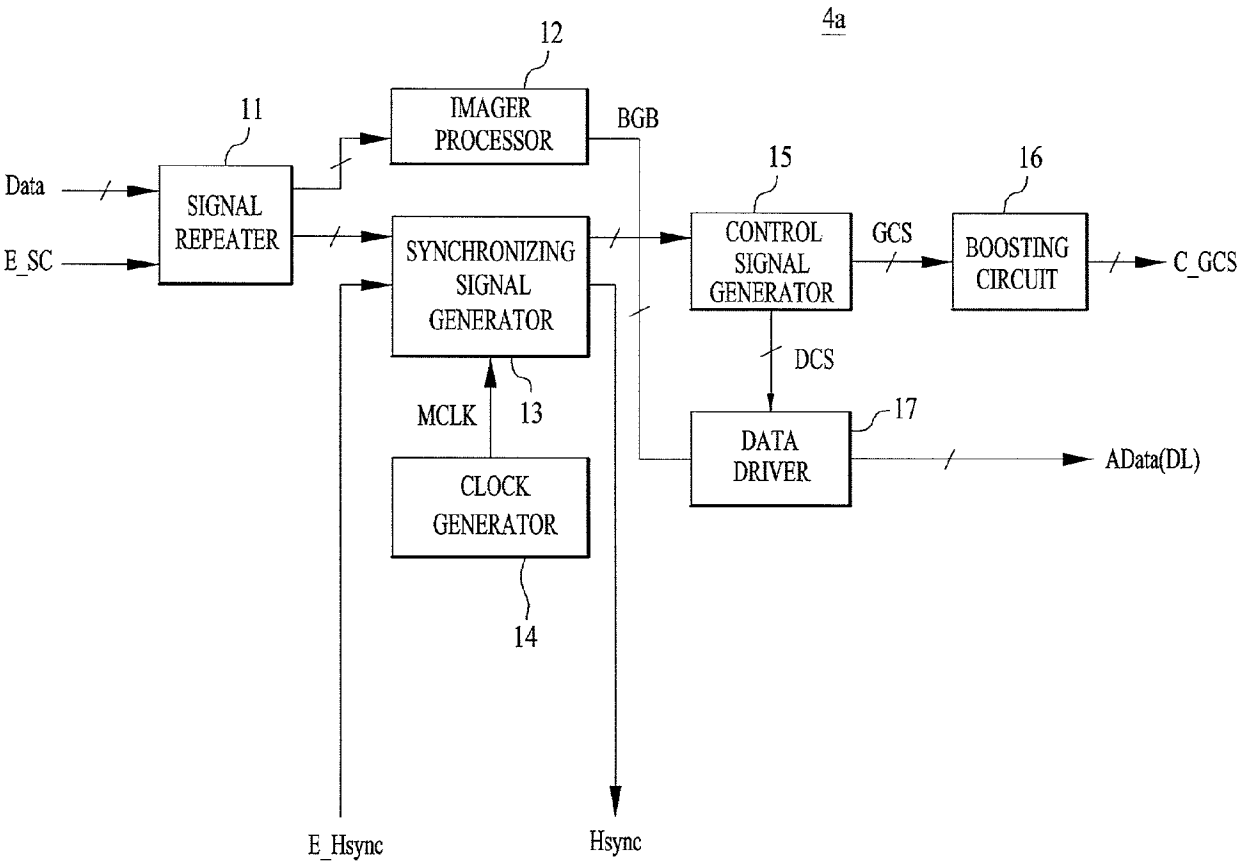
FIG. 3 is a block diagram illustrating a detailed configuration of one of the data integrated circuits shown in FIGS. 1 and 2.

FIG. 3 is a block diagram illustrating a detailed configuration of one of the data integrated circuits shown in FIGS. 1 and 2.

The data integrated circuit of FIG. 3, for example, the data integrated circuit 4*a*, includes a signal repeater 11 for not only repeating image data Data externally input to the data integrated circuit 4*a*, but also repeating synchronizing signals E_SC externally input to the data integrated circuit 4*a* when the synchronizing signals E_SC are input, an image processor 12 for aligning the image data Data supplied from the signal repeater 11 by the unit of at least one horizontal line such that the image data Data is suitable for driving the liquid crystal panel 2, and sequentially outputting the aligned data, namely, data RGB, a clock generator 14 for internally generating a main clock MCLK in real time in accordance with a predetermined frequency, and a synchronizing signal generator 13 for internally generating a horizontal synchronizing signal Hsync, using the main clock MCLK, and supplying the internally-generated horizontal synchronizing signal Hsync to the remaining driving integrated circuits. The synchronizing signal generator 13 also compares the internally-generated horizontal synchronizing signal Hsync with one or more externally-input horizontal synchronizing signals E_Hsync, and generates a vertical synchronizing signal in accordance with a result of the comparison. The data integrated circuit 4*a* also includes a control signal generator 15 for generating gate and data control signals, using one horizontal synchronizing signal selected from among the horizontal synchronizing signal Hsync internally generated from the synchronizing signal generator 13 and the externally-input horizontal synchronizing signals E_Hsync and the vertical synchronizing signal, a boosting circuit 16 for boosting the voltage level of the generated gate control signal, and supplying the boosted gate control signal to the gate driver 3, and a data driver 17 for converting the aligned image data RGB into analog image signal AData, and supplying the analog image signal AData to the data lines connected to the corresponding data integrated circuit, namely, the data integrated circuit 4*a*.

The signal repeater 11 sequentially supplies the externally-input image data Data to the image processor 12. When external synchronizing signals E_SC are input, the signal repeater 11 supplies the input external synchronizing signals E_SC to the synchronizing signal generator 13.

The image processor 12 aligns the image data Data supplied from the signal repeater 11 by the unit of at least one horizontal line such that the image data Data is suitable for driving the liquid crystal panel 2. That is, the image processor 12 detects image data Data sequentially input thereto in accordance with a data line driving position of the data integrated circuit, in which the image processor 12 is included, and then aligns the detected image data Data by the unit of at least one horizontal line in accordance with the corresponding image display region. In other words, since each of the data integrated circuits 4*a* to 4*c* only drives the data lines in a corresponding one of the image display regions of the liquid crystal panel 2, the image processor 12 of each data integrated circuit detects and aligns only a part of the image data corresponding to the overall horizontal lines in accordance with the data line driving position of the data integrated circuit, in which the image processor 12 is included. The image processor 12 then sequentially supplies the aligned image data RGB to the data driver 17.

The clock generator 14 includes at least one clock oscillator, to continuously generate a main clock MCLK in accordance with a predetermined frequency and to supply the main clock MCLK to the synchronizing signal generator 13 in real time.

Upon receiving the external synchronizing signals E_SC from the signal repeater 11, the synchronizing signal generator 13 supplies the external synchronizing signals E_SC to the control signal generator 15. When there is no externally-input synchronizing signal E_SC, the synchronizing signal generator 13 internally generates the horizontal synchronizing signal Hsync, to share the horizontal synchronizing signal Hsync with the remaining driving integrated circuits. The synchronizing signal generator 13 generates a vertical synchronizing signal, using a highest-frequency one of the internally-generated horizontal synchronizing signal Hsync and externally-input horizontal synchronizing signals E_Hsync.

Upon receiving the external synchronizing signals E_SC from the synchronizing signal generator 13, the control signal generator 15 generates gate and data control signals GCS and DCS, using the received external synchronizing signals E_SC. However, when the synchronizing signal generator 13 supplies the vertical synchronizing signal generated therefrom, together with the highest-frequency horizontal synchronizing signal, the control signal generator 15 generates gate and data signals GCS and DCS, using the supplied horizontal synchronizing signal and vertical synchronizing signal. The generated gate control signal GCS is supplied to the gate driver 3 via the boosting circuit 16. The data control signal DCS is supplied to the data driver 17. The gate control signal GCS includes a gate start pulse, a gate shift clock and a gate output enable signal to control the gate driver 3. The data control signal DSC includes a data start pulse, a data shift clock, a data output enable signal and a data polarity signal to control the data driver 17.

The boosting circuit 16 boosts the voltage level of at least one of the above-described gate control signals GCS, and supplies the boosted gate control signal CGSC to the gate driver 3.

The data driver 17 converts the aligned image data RGB supplied from the image processor 12 into analog voltages, namely, image signal AData, using the above-described data control signals GCS, namely, the source start pulse, source shift clock, source output enable signal, etc. In detail, the data driver 17 latches the aligned image data RGB in accordance with the source shift clock, and then supplies, to the data lines DL1 to DLm, the image signal AData for one horizontal line in every horizontal period, in which a scan pulse is supplied to one of the gate lines GL1 to GLn, in response to the source output enable signal.

Each of the data integrated circuits 4*a* to 4*c* may further include a gradation voltage generator for generating gradation voltages in accordance with a plurality of gamma voltage levels. The gradation voltage generator divides first and second reference voltages having positive and negative polarities, to generate a plurality of gradation voltages. In this case, the gradation voltage generator supplies the generated gradation voltages to the data driver 17. When the image data Data consists of N bits, the gradation voltage generator generates $2^N$ positive (+) and negative (−) gradation voltages.

Figure 4:
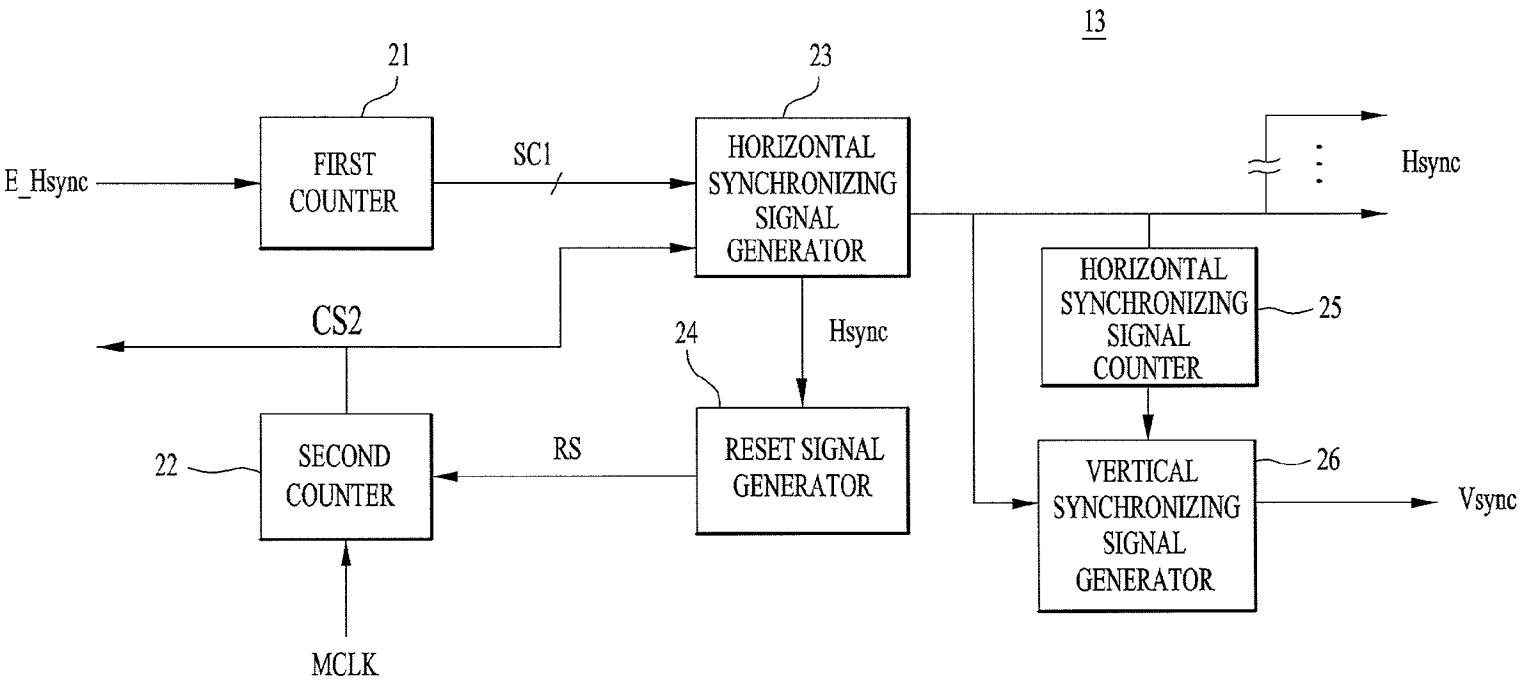
FIG. 4 is a block diagram illustrating a detailed configuration of a synchronizing signal generator shown in FIG. 3.

FIG. 4 is a block diagram illustrating a detailed configuration of the synchronizing signal generator shown in FIG. 3.

The synchronizing signal generator 13 of FIG. 4 includes a first counter 21 for counting the externally-input horizontal synchronizing signals E_Hsync, and generating a first count signal CS1 corresponding to a highest-frequency one of the counted horizontal synchronizing signals E_Hsync, a second counter 22 for counting the horizontal synchronizing signal Hsync internally generated from the synchronizing signal generator 13 in accordance with the main clock MCLK from the clock generator 14, and generating a second clock signal CS2 corresponding to the counted horizontal synchronizing signal Hsync, and a horizontal synchronizing signal generator 23 for comparing the first count signal CS1 and second count signal CS2, and internally generating a horizontal synchronizing signal Hsync, using a highest-frequency one of the first and second count signals CS1 and CS2. The synchronizing signal generator 13 also includes a reset signal generator 24 for supplying a reset signal RS to the second counter 22 in response to outputting of the horizontal synchronizing signal Hsync from the horizontal synchronizing signal generator 23, to reset the second counter 22, a horizontal synchronizing signal counter 25 for counting the horizontal synchronizing signal Hsync output from the horizontal synchronizing signal generator 23, and a vertical synchronizing signal generator 26 for generating a vertical synchronizing signal Vsync, using the horizontal synchronizing signal Hsync output from the horizontal synchronizing signal generator 23.

The first counter 21 counts one or more external horizontal synchronizing signals E_Hsync input from the remaining data integrated circuits, and generates a first count signal CS1 corresponding to a highest-frequency one of the counted horizontal synchronizing signals E_Hsync. The highest-frequency external horizontal synchronizing signal E_Hsync may be selected by counting clock pulses of the external horizontal synchronizing signals E_Hsync, and selecting the external horizontal synchronizing signal E_Hsync, the counted value of which most early reaches a predetermined count value, from among the external horizontal synchronizing signals E_Hsync. Even when the clock generators 14 of respective data integrated circuits 4*a* to 4*c* are set to have the same frequency, they have different frequency tolerances. For this reason, the horizontal synchronizing signals internally generated from respective data integrated circuits 4*a* to 4*c* have different frequency tolerances. To this end, the first counter 21 counts the external horizontal synchronizing signals E_Hsync, and generates the first count signal CS1, which corresponds to a highest-frequency one of the counted horizontal synchronizing signals E_Hsync. The first counter 21 supplies the first count signal CS1 to the horizontal synchronizing signal generator 23. Thus, the external horizontal synchronizing signal E_Hsync generated at a highest frequency can be supplied, as the first count signal CS1, to the horizontal synchronizing signal generator 23 because the first count signal CS1 is identical to the highest-frequency external horizontal synchronizing signal E_Hsync.

The second counter 22 counts the main clock MCLK or the horizontal synchronizing signal Hsync internally generated from the synchronizing signal generator 13, thereby generating a second clock signal CS2. The horizontal synchronizing signal Hsync internally generated from the horizontal synchronizing signal generator 13 may have the same clock waveform as the main clock MCLK. Accordingly, the second counter 22 achieves counting of the internally-generated horizontal synchronizing signal Hsync by counting the main clock MCLK.

The horizontal synchronizing signal generator 23 supplies the horizontal synchronizing signal Hsync corresponding to the second count signal CS2 to the first counters 21 of the remaining data integrated circuits. Also, the horizontal synchronizing signal generator 23 compares the first count signal CS1 and second count signal CS2, thereby internally generating a horizontal synchronizing signal Hsync corresponding to a higher-frequency one of the first and second count signals CS1 and CS2. The horizontal synchronizing signal generator 23 then compares the internally-generated horizontal synchronizing signal Hsync with external horizontal synchronizing signals respectively input from the remaining driving integrated circuits, thereby selecting a highest-frequency one of the horizontal synchronizing signals. Accordingly, the data drivers 17 of the driving integrated circuits 4*a* to 4*c* can be driven in sync with the selected horizontal synchronizing signal. Since the data drivers 17 of the driving integrated circuits 4*a* to 4*c* are driven in sync with the highest-frequency horizontal synchronizing signal, all driving integrated circuits 4*a* to 4*c* can be synchronously driven.

The reset signal generator 24 supplies a reset signal RS to the second counter 22 in response to outputting of the horizontal synchronizing signal Hsync from the horizontal synchronizing signal generator 23, to reset the second counter 22. Thus, it is possible not only to employ an internally-generated horizontal synchronizing signal when the internally-generated horizontal synchronizing signal has a highest frequency, but also to employ an externally-input horizontal synchronizing signal when the externally-input horizontal synchronizing signal has a higher frequency than the internally-generated horizontal synchronizing signal.

Figure 5:
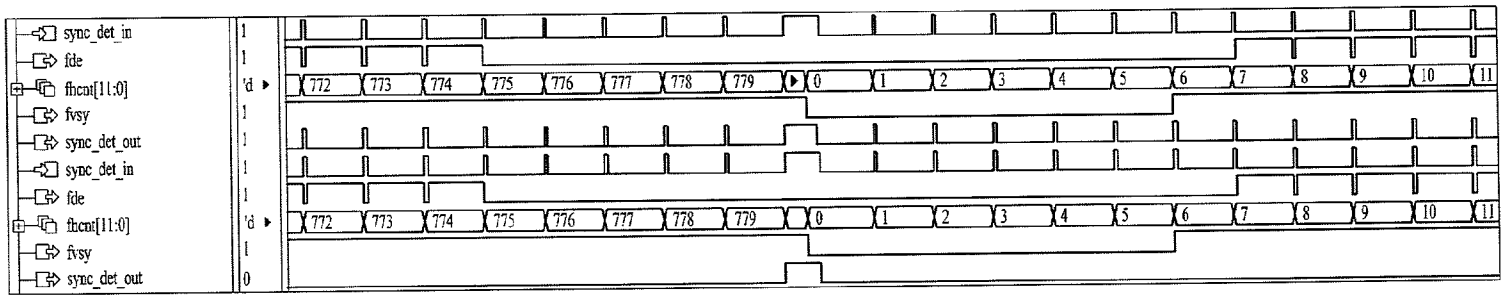
FIG. 5 is a waveform diagram showing outputting of control signals at the same timing in accordance with synchronization of the plural driving integrated circuits.

FIG. 5 is a waveform diagram showing outputting of control signals at the same timing in accordance with synchronization of the plural driving integrated circuits.

Referring to FIG. 5, all driving integrated circuits according to the present invention, namely, the driving integrated circuits 4*a* to 4*c*, compare horizontal synchronizing signals internally generated therefrom, and drive the data drivers 17 thereof in sync with a highest-frequency one of the horizontal synchronizing signals. Accordingly, all driving integrated circuits 4*a* to 4*c* can be synchronously driven. That is, the data integrated circuits 4*a* to 4*c* generate data control signals to control respective data drivers 17 thereof in sync with the highest-frequency horizontal synchronizing signal and, as such, they can be synchronously driven. Thus, it is possible to avoid a degradation in picture quality caused by erroneous driving timing because the driving integrated circuits, which drive the image display panel, using driving control signals internally generated therefrom, can be synchronously driven. It is also possible to achieve an enhancement in product reliability in accordance with avoidance of a degradation in picture quality caused by erroneous driving timing.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving an image display device comprising:

a display panel, which comprises a plurality of pixel regions, to display an image;

a plurality of data integrated circuits, which share at least one of synchronizing signals internally generated therefrom, generate gate and data control signals in accordance with the shared synchronizing signal, and drive data lines of the display panel, using the internally-generated data control signals; and a gate driver that drives gate lines of the display panel in accordance with the gate control signal generated from one of the plurality of data integrated circuits, wherein each of the data integrated circuits comprises:

a clock generator for internally generating a main clock in real time in accordance with a predetermined frequency;

a synchronizing signal generator for internally generating a horizontal synchronizing signal, using the main clock, supplying the internally-generated horizontal synchronizing signal to remaining ones of the driving integrated circuits, comparing the internally-generated horizontal synchronizing signal with one or more externally-input horizontal synchronizing signals, and generating a vertical synchronizing signal, using one of the compared horizontal synchronizing signals, which is selected in accordance with a result of the comparison; and a control signal generator for generating the gate and data control signals, using one horizontal synchronizing signal selected from among the horizontal synchronizing signal internally generated from the synchronizing signal generator and the externally-input horizontal synchronizing signals and the vertical synchronizing signal.

2. The apparatus according to claim 1, wherein each of the data integrated circuits further comprises:

a signal repeater that repeats image data externally input to the data integrated circuit, and repeats synchronizing signals externally input to the data integrated circuit when the synchronizing signals are input; and an image processor that aligns the image data supplied from the signal repeater by a unit of at least one horizontal line such that the image data is suitable for driving the display panel, and sequentially outputting the aligned data.

3. The apparatus according to claim 1, wherein:

the synchronizing signal generator supplies the external synchronizing signals to the control signal generator, upon receiving the external synchronizing signals from the signal repeater; and the synchronizing signal generator internally generates the horizontal synchronizing signal, to share the horizontal synchronizing signal with the remaining driving integrated circuits, when there is no externally-input horizontal synchronizing signal, and generates the vertical synchronizing signal, using a highest-frequency one of the internally-generated horizontal synchronizing signal and the externally-input horizontal synchronizing signals.

4. The apparatus according to claim 3, wherein the synchronizing signal generator comprises:

a first counter that counts the externally-input horizontal synchronizing signals, and generates a first count signal corresponding to a highest-frequency one of the counted horizontal synchronizing signals;

a second counter that counts the horizontal synchronizing signal internally generated from the synchronizing signal generator in accordance with the main clock from the clock generator, and generates a second count signal corresponding to the counted horizontal synchronizing signal;

a horizontal synchronizing signal generator that compares the first count signal and the second count signal, and internally generates the horizontal synchronizing signal, using a highest-frequency one of the first and second count signals;

a reset signal generator that supplies a reset signal to the second counter in response to outputting of the horizontal synchronizing signal from the horizontal synchronizing signal generator, to reset the second counter;

a horizontal synchronizing signal counter that counts the horizontal synchronizing signal output from the horizontal synchronizing signal generator; and a vertical synchronizing signal generator that generates a vertical synchronizing signal, using the horizontal synchronizing signal output from the horizontal synchronizing signal generator.

5. The apparatus according to claim 4, wherein the horizontal synchronizing signal generator supplies the horizontal synchronizing signal corresponding to the second count signal to the first counters of the remaining data integrated circuits, and compares the first count signal and the second count signal, thereby internally generating a horizontal synchronizing signal corresponding to a higher-frequency one of the first and second count signals.

6. A method for driving an image display device, comprising:

sharing, by a plurality of data integrated circuits, at least one of synchronizing signals internally generated from the plural data integrated circuits, internally generating gate and data control signals from the plural data integrated circuits in accordance with the shared synchronizing signal, and driving data lines of a display panel, using the internally-generated data control signals; and driving gate lines of the display panel in accordance with the gate control signal of one of the plural data integrated circuits, wherein the step of generating the gate and data control signals from each of the plural data integrated circuits comprises the steps of:

internally generating a main clock in real time by a clock generator in accordance with a predetermined frequency;

internally generating a horizontal synchronizing signal by a synchronizing signal generator, using the main clock, supplying the internally-generated horizontal synchronizing signal to remaining ones of the driving integrated circuits, comparing the internally-generated horizontal synchronizing signal with one or more externally-input horizontal synchronizing signals, and generating a vertical synchronizing signal, using one of the compared horizontal synchronizing signals, which is selected in accordance with a result of the comparison; and generating the gate and data control signals by a control signal generator using one horizontal synchronizing signal selected from among the horizontal synchronizing signal internally generated from the synchronizing signal generator and the externally-input horizontal synchronizing signals and the vertical synchronizing signal.

7. The method according to claim 6, wherein generating the gate and data control signals from each of the plural data integrated circuits further comprises:

repeating externally-input image data by a signal repeater, and repeating externally-input synchronizing signals by the signal repeater, upon receiving the externally-input synchronizing signals; and aligning, by an image processor, the image data supplied from the signal repeater by a unit of at least one horizontal line such that the image data is suitable for driving the display panel, and sequentially outputting the aligned data;

internally generating a main clock in real time by a clock generator in accordance with a predetermined frequency.

8. The method according to claim 6, wherein generating the vertical synchronizing signal comprises:

supplying the externally-input horizontal synchronizing signals to the control signal generator, upon receiving the externally-input horizontal synchronizing signals from a signal repeater; and internally generating the horizontal synchronizing signal, to share the horizontal synchronizing signal with the remaining driving integrated circuits, when there is no externally-input horizontal synchronizing signal, and generating the vertical synchronizing signal, using a highest-frequency one of the internally-generated horizontal synchronizing signal and the externally-input horizontal synchronizing signals.

9. The method according to claim 8, wherein generating the vertical synchronizing signal comprises:

counting the externally-input horizontal synchronizing signals by a first counter, and generating a first count signal corresponding to a highest-frequency one of the counted horizontal synchronizing signals;

counting the horizontal synchronizing signal internally generated from the synchronizing signal generator in accordance with the main clock from the clock generator by a second counter, and generating a second count signal corresponding to the counted horizontal synchronizing signal;

comparing the first count signal and the second count signal, and internally generating the horizontal synchronizing signal by a horizontal synchronizing signal generator, using a highest-frequency one of the first and second count signals;

supplying a reset signal to the second counter by a reset signal generator in response to outputting of the horizontal synchronizing signal from the horizontal synchronizing signal generator, to reset the second counter;

counting the horizontal synchronizing signal output from the horizontal synchronizing signal generator by a horizontal synchronizing signal counter; and generating a vertical synchronizing signal by a vertical synchronizing signal generator, using the horizontal synchronizing signal output from the horizontal synchronizing signal generator.

10. The method according to claim 9, wherein internally generating the horizontal synchronizing signal comprises supplying the horizontal synchronizing signal corresponding to the second count signal to the first counters of the remaining data integrated circuits, and comparing the first count signal and the second count signal, thereby internally generating the horizontal synchronizing signal corresponding to a higher-frequency one of the first and second count signals.

* * * * *